US005078625A

United States Patent [19]

Anzai

[11] Patent Number: 5,078,625

[45] Date of Patent: Jan. 7, 1992

[54] WEDGE BASE SOCKET ATTACHED TO SPG SUBSTRATE

[75] Inventor: Hiroto Anzai, Tokyo, Japan

[73] Assignee: Stanley Electric Co., Ltd., Tokyo, Japan

[21] Appl. No.: 538,930

[22] Filed: Jun. 15, 1990

[30] Foreign Application Priority Data

Jun. 20, 1989 [JP] Japan ..... 1-71953

[51] Int. Cl.[5] ..... H01R 17/00

[52] U.S. Cl. ..... 439/699; 439/356

[58] Field of Search ..... 439/78, 516, 56, 552, 439/553, 554, 567, 547, 611, 619, 699; 313/318

[56] References Cited

U.S. PATENT DOCUMENTS

| | | | |
|---|---|---|---|
| 3,048,642 | 8/1962 | Parker, Jr. . | |
| 3,233,207 | 2/1966 | Ahroni et al. . | |
| 3,399,374 | 8/1968 | Parza et al. . | |
| 3,859,554 | 1/1975 | Preziosi et al. | 313/318 |
| 3,864,001 | 2/1975 | Millet | 439/547 |
| 4,152,622 | 5/1979 | Fitzgerald . | |
| 4,171,497 | 10/1979 | Shinoda . | |
| 4,246,632 | 1/1981 | Hancox | 439/56 |
| 4,471,158 | 9/1984 | Roberts | 439/516 |
| 4,592,606 | 6/1986 | Mudra | 439/516 |
| 4,759,730 | 7/1988 | Sappington et al. . | |
| 4,947,082 | 8/1990 | French | 313/318 |

FOREIGN PATENT DOCUMENTS

| | | | |
|---|---|---|---|
| 1-84568 | 3/1989 | Japan | 313/318 |

OTHER PUBLICATIONS

"Multiple Lamp Socket", GW Hieronymous, IBM Tech. Disclosure Bulletin, vol. 15, No. 3, p. 879.

Japanese Industrial Standard (JIS), Galvanized Sheets, JIS G 3302, Translated and Published by Japanese Standards Association, 1979, revised Sep. 1987.

*Primary Examiner*—David L. Pirlot

*Attorney, Agent, or Firm*—Frishauf, Holtz, Goodman & Woodward

[57] ABSTRACT

A wedge base socket for an SPG substrate comprises a terminal having a bulb connection member and a casing to hold a base of a bulb. The terminal and the casing are individually mountable onto the SPG substrate without requiring a mounting hole in the SPG substrate. A pair of the terminals are preformed and are connected by a provisional bridge which facilitates insertion into substrate. The provisional bridge is broken off after assembly.

15 Claims, 2 Drawing Sheets

WEDGE BASE SOCKET ATTACHED TO SPG SUBSTRATE

BACKGROUND OF THE INVENTION

1. Field of the Invention

This invention relates to an SPG substrate (i.e., a substrate made of galvanized sheet material, as is known in the art) used for a circuit substrate in a rear face of an automobile meter panel or where an electric wiring and bulb as a rear combination lamp is used. Such a circuit substrate is generally punched from, for example, a metal sheet in a convenient form to form a circuit member, and a wedge base socket or receptacle is attached to the SPG substrate.

2. Description of the Prior Art

Conventionally, as seen in FIG. 4, when a wedge base socket 32 is to be attached to an SPG substrate 31, an existing wedge base socket 32, for example is used, and a mounting hole 31*a* in a convenient shape is provided through the SPG substrate 31, on which a circuit member 33 is mounted, the circuit member 33 being formed generally in a fan shaped. However, the conventional construction shown in FIG. 4 has a drawback in that a mounting hole 31*a* is needed at a mounting position, since the wedge base socket 32 is an existing one, and an enlarged area at the mounting position is required, which causes the SPG substrate 31 to be larger or it is required to detour the circuit member 33. This causes the form of substrate 31 to be complicated. Furthermore, a preassembly process is required for the wedge base socket 32. These problems have not yet been resolved.

SUMMARY OF THE INVENTION

The object of the present invention is to provide a wedge base socket attached to an SPG substrate having thereon a circuit substrate formed of a wire conductive member, which solves the conventional problems.

The wedge base socket of the present invention comprises a terminal member having (i) at one end portion thereof, a circuit connection member which is conductively coupled a circuit member on the SPG substrate, and (ii) at another end portion thereof, a spring-like bulb connection member adapted to be pressed against a base member of a wedge base bulb. A casing made of an insulation member is provided to hold the base member of the wedge base bulb. Each of the terminal member and the casing member is individually mountable onto the SPG substrate.

DETAILED DESCRIPTION

Figure 1:
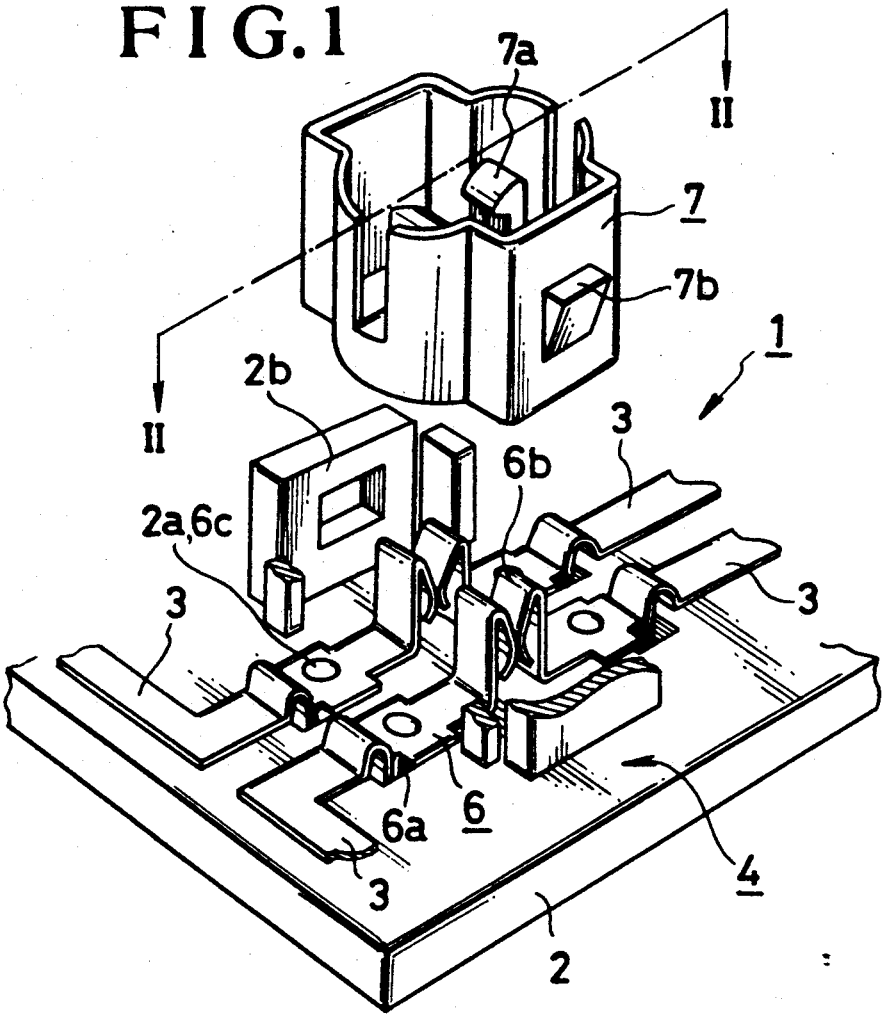
FIG. 1 is an exploded perspective view showing one embodiment of a wedge base socket on an SPG substrate according to the present invention.
Figure 2:
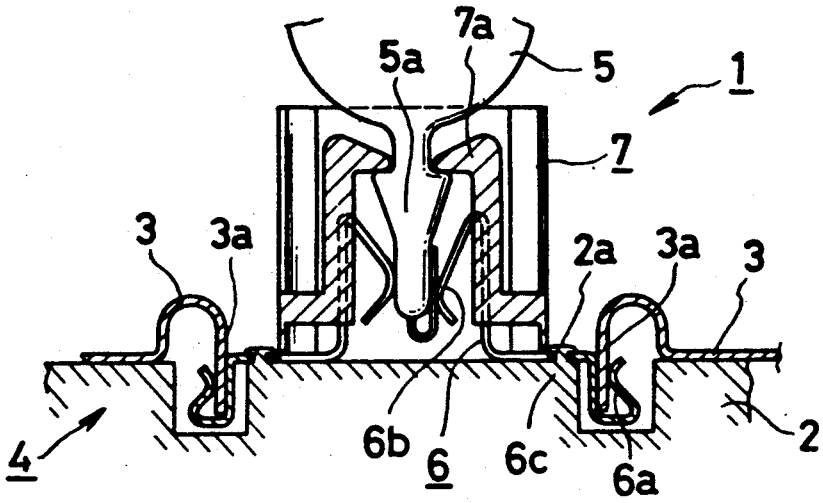
FIG. 2 is a cross-section along line II—II in FIG. 1.

FIGS. 1 and 2 show a wedge base socket (hereinafter socket or receptacle 1) which is mounted onto an SPG substrate 4 comprising a substrate 2 and a circuit member 3. The socket 1 is similar to a conventional socket in that a base 5*a* (see FIG. 2) of a wedge base bulb 5 (hereinafter bulb 5) is mounted therein, but the socket 1 is only for use with the SPG substrate 4 of the present invention.

The socket 1 will be hereinafter discussed in detail. The socket 1 comprises a terminal member 6 and a casing 7. The terminal 6 is formed in generally linear form from a resilient metal member such as phosphorous copper plate or brass plate usually used for a spring. One end of terminal member 6 is formed in a shape to sandwich a receiving terminal 3*a* of the electrical receptacle, to form the circuit connection member 6*a*, and another end thereof is folded back to form a compressive spring to form a bulb connecting member 6*b*.

At a convenient portion in terminal member 6 is an opening 6*c* to receive a pin 2*a* (see FIG. 2) provided on the substrate 2 of the SPG substrate 4, the top of pin 2*a* being heated to be deformed (FIG. 2) so that it secures the terminal member 6 in place.

The casing member 7 is formed from an insulating material such as a synthetic resin on which a clip member 7*a* to hold the base member 5*a* of the bulb 5 is provided. A male member 7*b* (FIG. 1), matable to an opening in a guide member 2*b* provided on the substrate, is provided on opposite sides of the casing member 7 to secure casing member 7 onto the substrate 2 solely by the male members 7*b* on the casing member 7 engaging respective guide members 2*b*. To this end, the pins 2*a* and the guide members 2*b* are conveniently provided at positions where each of the terminal member 6 and the casing member 7 are respectively mounted; i.e., where the bulb 5 is attached. When the socket 1 of the above described construction is assembled onto the substrate 2, the pre-bent terminal member 6 is first inserted onto the substrate 2, then the circuit member 3 is mounted onto the substrate 2 in a similar manner, so that a generally L-shaped tip end 3*a* of the circuit member 3 is sandwiched by the circuit connection member 6*a*, thereby to electrically connect the circuit member 3 and the terminal member 6 and to simultaneously locate them at a given position.

Then, after fixing the circuit member 3 and terminal member 6 on the substrate by convenient means such as heat mating, the casing member 7 is inserted into a given position of the substrate 2, thereby completing the assembly of the socket 1. The socket 1 is assembled simultaneously with assembly of the SPG substrate 4. Therefore, a subsequent assembly process of the socket 1 is eliminated, and a mounting hole for its assembly is also eliminated.

Figure 3:
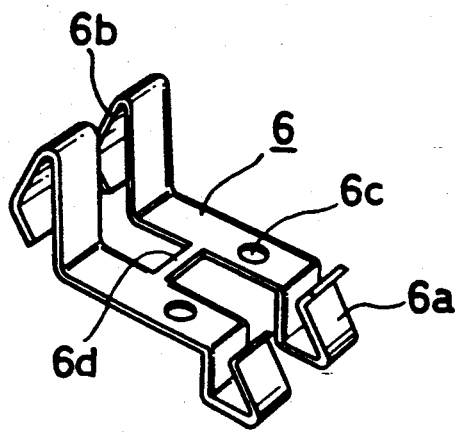
FIG. 3 is a perspective view showing a major portion according to another embodiment of the present invention.
Figure 4:
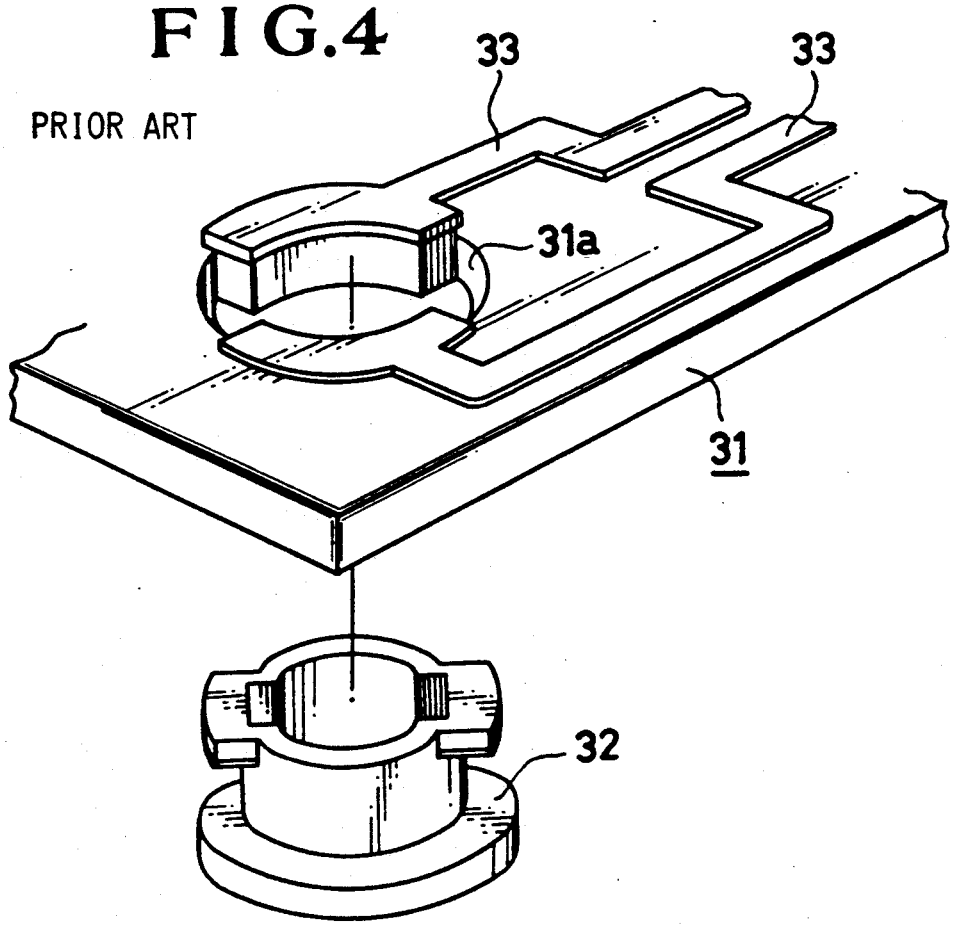
FIG.4 PRIOR ART
FIG. 4 shows a prior art configuration.

FIG. 3 shows a main portion of another embodiment of this invention. The terminal member 16 of FIG. 3 is preformed such that it comprises a pair of left and right members connected together by a provisional bridge 16*d*. This arrangement reduces the mounting process in half when the terminal member 16 is mounted onto the substrate 2. The provisional bridge 6*d* is provided to reduce working time during assembly. The provisional bridge 6*d* is cut off after assembly.

As discussed above, according to the present invention, the wedge base socket comprises a terminal member made of conductive resilient material having at one end thereof a circuit connection member sandwiched onto the circuit member, and at another end thereof a bulb connection member pressed against the base member of the wedge base bulb. The casing member is made of insulating material and holds the base member of the wedge base bulb. The conductive terminal member and the insulating casing member are individually mountable onto the SPG substrate.

To this end, first a mounting hole for the wedge base socket is no longer needed in the SPG substrate which causes the design to be compact and simple for wiring, and secondly, the wedge base socket is assembled simultaneously with the assembly of the SPG substrate so as to enable the production line to be simple. Therefore, the production cost is reduced.

What is claimed is:

1. A wedge base socket mounted onto an SPG substrate (4) having a conductive circuit member (3) thereon, and for mounting a bulb thereon substantially perpendicular to the substrate, without having a socket-receiving opening in the SPG substrate, the wedge base socket comprising:

a conductive terminal member (6) having a circuit connection member (6*a*) at a first end portion thereof which is conductively coupled to said circuit member (3), and a spring-like bulb connection member (6*b*) adapted to be pressed against a base member of a wedge base bulb at another end portion thereof;

a casing member of insulating material including means for engaging and holding the base member of the wedge base bulb, said casing member further including means for receiving at least a portion of said bulb connection member (6*b*) for enabling an engaged base member of a wedge base lamp to electrically connect with said bulb connection member (6*b*) with said lamp extending substantially perpendicular to said substrate; and means for individually mounting and fixing said conductive terminal member and said casing member on said SPG substrate, independently of each other, without requiring a through socket-receiving hole in said SPG substrate.

2. A wedge base socket mounted on an SPG substrate according to claim 1, comprising a pair of said conductive terminal members which are preformed at at least said end portions thereof, and a bridge member (6*d*) connecting said pair of terminal members (6) together for ease of assembly, said bridge member (6*d*) being breakable after assembly on said SPG substrate to disconnect said terminal members (6) from each other.

3. A wedge base socket according to claim 1, comprising a pair of said terminal members (6) electrically insulated from each other and fixed on said SPG substrate, each said terminal member being electrically connected to a respective circuit member (3) on said SPG substrate.

4. A wedge base socket according to claim 1, wherein said circuit connection member (6*a*) at said first end of said terminal member comprises means for sandwiching and engaging said circuit member (3) to which it is electrically coupled.

5. A wedge base socket according to claim 1, wherein said projection (2*a*) has an enlarged top portion which is formed after insertion in said opening (6*c*) to retain said terminal member in a fixed position.

6. A wedge base socket according to claim 1, wherein said means for mounting and fixing said casing member on said SPG substrate comprises:

projection (7*b*) on said casing member; and upstanding means (2*b*) on said substrate and having an opening therein for receiving said projection (7*b*).

7. A wedge base socket according to claim 6, wherein said upstanding means (2*b*) and said projection (7*b*) have some resiliency to permit yielding engagement therebetween.

8. A wedge base socket according to claim 7, wherein said projection (7*b*) has an inclined lead-in surface for sliding on said upstanding means (2*b*) during interengagement thereof.

9. A wedge base socket according to claim 1, wherein said means for mounting and fixing said casing member on said SPG substrate comprises:

a projection (7*b*) on said casing member; and upstanding means (2*b*) on said substrate and having an opening therein for receiving said projection (7*b*).

10. A wedge base socket according to claim 9, wherein said upstanding means (2*b*) and said projection (7*b*) have some resiliency to permit yielding engagement therebetween.

11. A wedge base socket according to claim 10, wherein said projection (7*b*) has an inclined lead-in surface for sliding on said upstanding means (2*b*) during interengagement thereof.

12. A wedge base socket mounted onto an SPG substrate (4) having a conductive circuit member (3) thereon, without having a socket-receiving opening in the SPG substrate, the wedge base socket comprising:

a conductive terminal member (6) having a circuit connection member (6*a*) at a first end portion thereof which us conductively coupled to said circuit member (3), and a spring-like bulb connection member (6*b*) adapted to be pressed against a base member of a wedge base bulb at another end portion thereof;

a casing member of insulating material including means for engaging and holding the base member of the wedge base bulb, said casing member further including means for receiving at least a portion of said bulb connection member (6*b*) for enabling an engaged base member of a wedge base lamp to electrically connect with said bulb connection member (6*b*); and means for individually mounting and fixing said conductive terminal member (6) and said casing member on said SPG substrate;

said means for mounting and fixing said conductive terminal member (6) on said SPG substrate comprises:

an opening (6*c*) in a portion of said terminal member (6); and a projection (2*a*) on said SPG substrate which extends into said opening of said terminal member; and said means for mounting and fixing said casing member on said SPG substrate comprises:

a projection (7*b*) on said casing member; and upstanding means (2*b*) on said substrate and having an opening thereon for receiving said projection (7*b*).

13. A wedge base socket according to claim 12, wherein said projection (2*a*) has an enlarged top portion which is formed after insertion in said opening (6*c*) to retain said terminal member in a fixed position.

14. A wedge base socket according to claim 12, wherein said upstanding means (2*b*) and said projection (7*b*) have some resiliency to permit yielding engagement therebetween.

15. A wedge base socket according to claim 14, wherein said projection (7*b*) has an inclined lead-in surface for sliding on said upstanding means (2*b*) during interengagement thereof.

* * * * *

UNITED STATES PATENT AND TRADEMARK OFFICE

CERTIFICATE OF CORRECTION

PATENT NO. : 5,078,625

DATED : January 7, 1992

INVENTOR(S) : Hiroto ANZAI

It is certified that error appears in the above-identified patent and that said Letters Patent is hereby corrected as shown below:

Column 3, line 40 (claim 2), after "members", insert --(6-Fig.3)--.

Signed and Sealed this

Sixth Day of July, 1993

Michael K. Kirk

MICHAEL K. KIRK

*Acting Commissioner of Patents and Trademarks*

*Attest:*

*Attesting Officer*

UNITED STATES PATENT AND TRADEMARK OFFICE

CERTIFICATE OF CORRECTION

PATENT NO. : 5,078,625

DATED : January 7, 1992

INVENTOR(S) : ANZAI, Hiroto

It is certified that error appears in the above-identified patent and that said Letters Patent is hereby corrected as shown below:

Column 4, line 27 (claim 12), change "us" to --is--.

Signed and Sealed this

Twenty-ninth Day of November, 1994

*Attest:*

*Attesting Officer*

Bruce Lehman

BRUCE LEHMAN

*Commissioner of Patents and Trademarks*